US011234576B2

(12) United States Patent
Durham et al.

(10) Patent No.: US 11,234,576 B2
(45) Date of Patent: Feb. 1, 2022

(54) DISHWASHING APPLIANCES AND METHODS FOR ADDRESSING OBSTRUCTION THEREIN

(71) Applicant: Haier US Appliance Solutions, Inc., Wilmington, DE (US)

(72) Inventors: Kyle Edward Durham, Louisville, KY (US); Christopher Brandon Ross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 63 days.

(21) Appl. No.: 16/406,268

(22) Filed: May 8, 2019

(65) Prior Publication Data

US 2020/0352408 A1 Nov. 12, 2020

(51) Int. Cl.
*A47L 15/00* (2006.01)
*A47L 15/42* (2006.01)

(52) U.S. Cl.
CPC ..... *A47L 15/0031* (2013.01); *A47L 15/4225* (2013.01); *A47L 2401/08* (2013.01); *A47L 2401/14* (2013.01); *A47L 2401/34* (2013.01); *A47L 2501/02* (2013.01); *A47L 2501/26* (2013.01)

(58) Field of Classification Search
CPC ..... A47L 15/0031
See application file for complete search history.

(56) References Cited

U.S. PATENT DOCUMENTS

| | | | | |
|---|---|---|---|---|
| 5,762,080 | A * | 6/1998 | Edwards | A47L 15/4206 134/104.1 |
| 9,565,987 | B2 | 2/2017 | Poyner et al. | |
| 9,872,597 | B2 | 1/2018 | Pers et al. | |
| 2009/0000671 | A1 | 1/2009 | Montagnana | |
| 2013/0008477 | A1 | 1/2013 | Forst et al. | |
| 2015/0265128 | A1* | 9/2015 | Pers | A47L 15/4202 134/18 |
| 2018/0310798 | A1* | 11/2018 | Persson | A47L 15/4225 |

FOREIGN PATENT DOCUMENTS

CN 103120576 B 9/2015

* cited by examiner

*Primary Examiner* — Jason Y Ko
(74) *Attorney, Agent, or Firm* — Dority & Manning, P.A.

(57) ABSTRACT

Dishwashing appliances and methods, as provided herein, may include features or steps such as activating the drain pump for an activation period and receiving a pump-status signal during the activation period. Dishwashing appliances and methods may further include features or steps for detecting a pressure (P1) upstream from the drain pump during the activation period, determining a condition at the filter based on the pump-status signal and P1, and directing the drain pump based on the determined condition.

10 Claims, 8 Drawing Sheets

DISHWASHING APPLIANCES AND METHODS FOR ADDRESSING OBSTRUCTION THEREIN

FIELD OF THE INVENTION

The present subject matter relates generally to dishwashing appliances, and more particularly to features and methods for addressing obstructions or clogs in a dishwashing appliance.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash fluid (e.g., water, detergent, etc.) towards articles disposed within the rack assemblies in order to clean such articles. Dishwashing appliances are also typically equipped with one or more pumps, such as a circulation pump or a drain pump, for directing or motivating wash fluid from the wash chamber (e.g., to the spray assemblies or an area outside of the dishwashing appliance).

Conventional dishwashing appliances include one or more filter assemblies for filtering the wash fluid exiting the wash chamber. Depending upon the level of soil upon the articles, fluids used during wash and rinse cycles will become contaminated with sediment (e.g., soil, food particles, etc.) in the form of debris or particles that are carried with the fluid. In order to protect the pump and recirculate the fluid through the wash chamber, it is beneficial to filter the fluid so that relatively clean fluid is applied to the articles in the wash chamber and materials are removed or reduced from the fluid supplied to the pump. As a result, a filter assembly may be provided within or below a sump portion of the tub.

Over time and after repeated use of a dishwashing appliance, sediment may accumulate within a filter assembly. If left unaddressed, the accumulation may lead to obstructions or clogs in the sump, pump, or another portion of a fluid flow path. This may produce undesirable noises, impair appliance performance, and may even damage the dishwashing appliance. It may be useful for a filter assembly to be regularly cleaned, but this can be difficult for a user. Often, users are unaware of the recommended cleaning schedule for the filter assembly. Moreover, even if a recommended schedule for cleaning is known, a particular dishwasher may deviate from the schedule. In other words, the filter assembly may become dirty faster or slower than predicted by the schedule.

Accordingly, dishwashing appliances that include features for addressing or monitoring obstructions within a filter assembly and methods therefore that address one or more of the challenges noted above would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwashing appliance is provided. The method may include steps for activating the drain pump for an activation period and receiving a pump-status signal during the activation period. The method may further include steps for detecting a pressure (P1) upstream from the drain pump during the activation period, determining a condition at the filter based on the pump-status signal and P1, and directing the drain pump based on the determined condition.

In another exemplary aspect of the present disclosure, a dishwashing appliance is provided. The dishwashing appliance may include a cabinet, a tub, a spray assembly, a drain pump, a pressure sensor, and a controller. The tub may be positioned within the cabinet and may define a wash chamber for receipt of articles for washing. The spray assembly may be positioned within the wash chamber. The drain pump may be in fluid communication with the wash chamber. The pressure sensor may be upstream of the drain pump. The controller may be in operative communication with the pressure sensor and the drain pump. The controller may be configured to initiate a wash operation. The wash operation may include activating the drain pump for an activation period, receiving a pump-status signal during the activation period, detecting a pressure (P1) upstream from the drain pump during the activation period, determining a condition at the filter based on the pump-status signal and P1, and directing the drain pump based on the determined condition.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
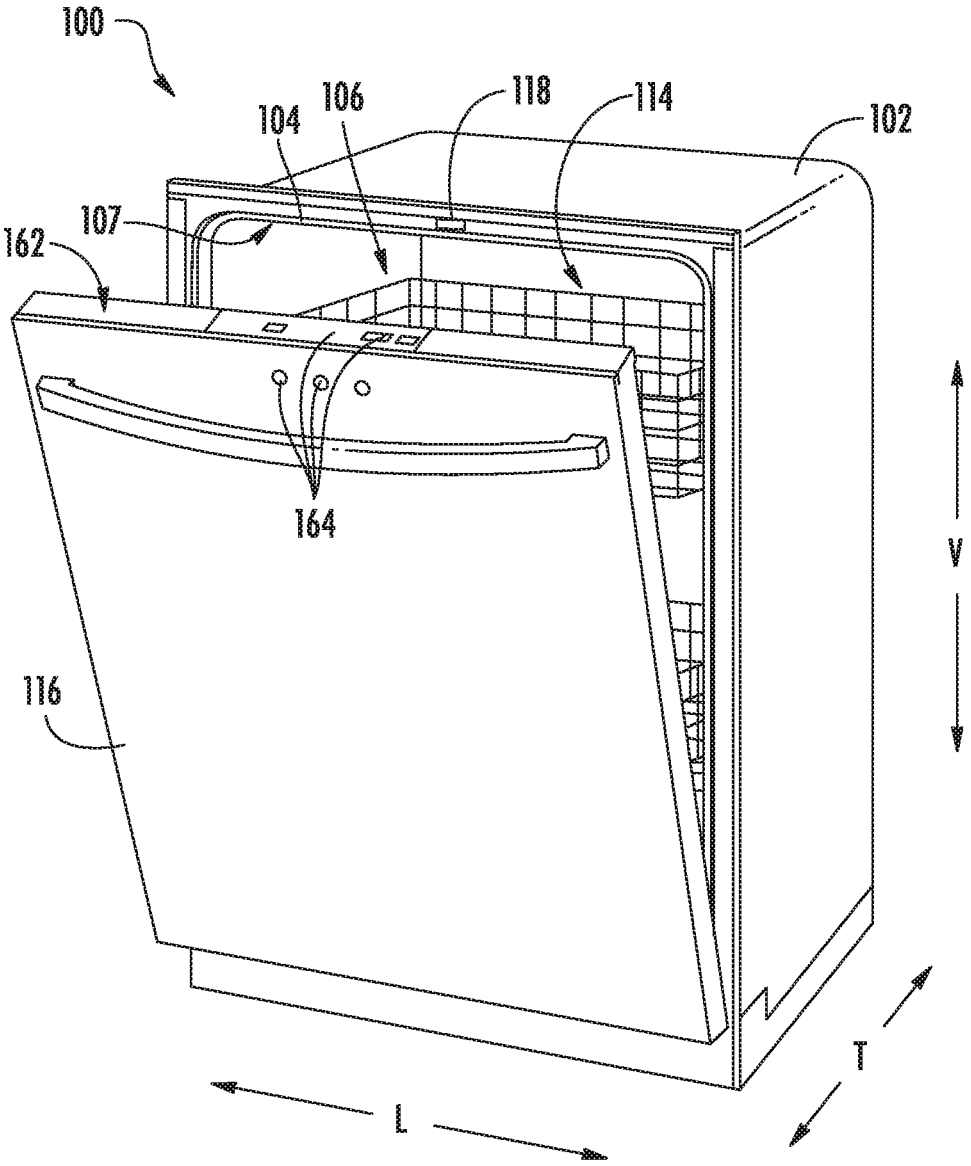
FIG. 1 provides a perspective view of an exemplary embodiment of a dishwashing appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash fluid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing or rinsing the articles that is typically made up of water and may include additives, such as detergent or other treatments (e.g., rinse aid). Furthermore, as used herein, terms of approximation, such as "approximately," "substantially," or "about," refer to being within a ten percent (10%) margin of error.

Figure 2:
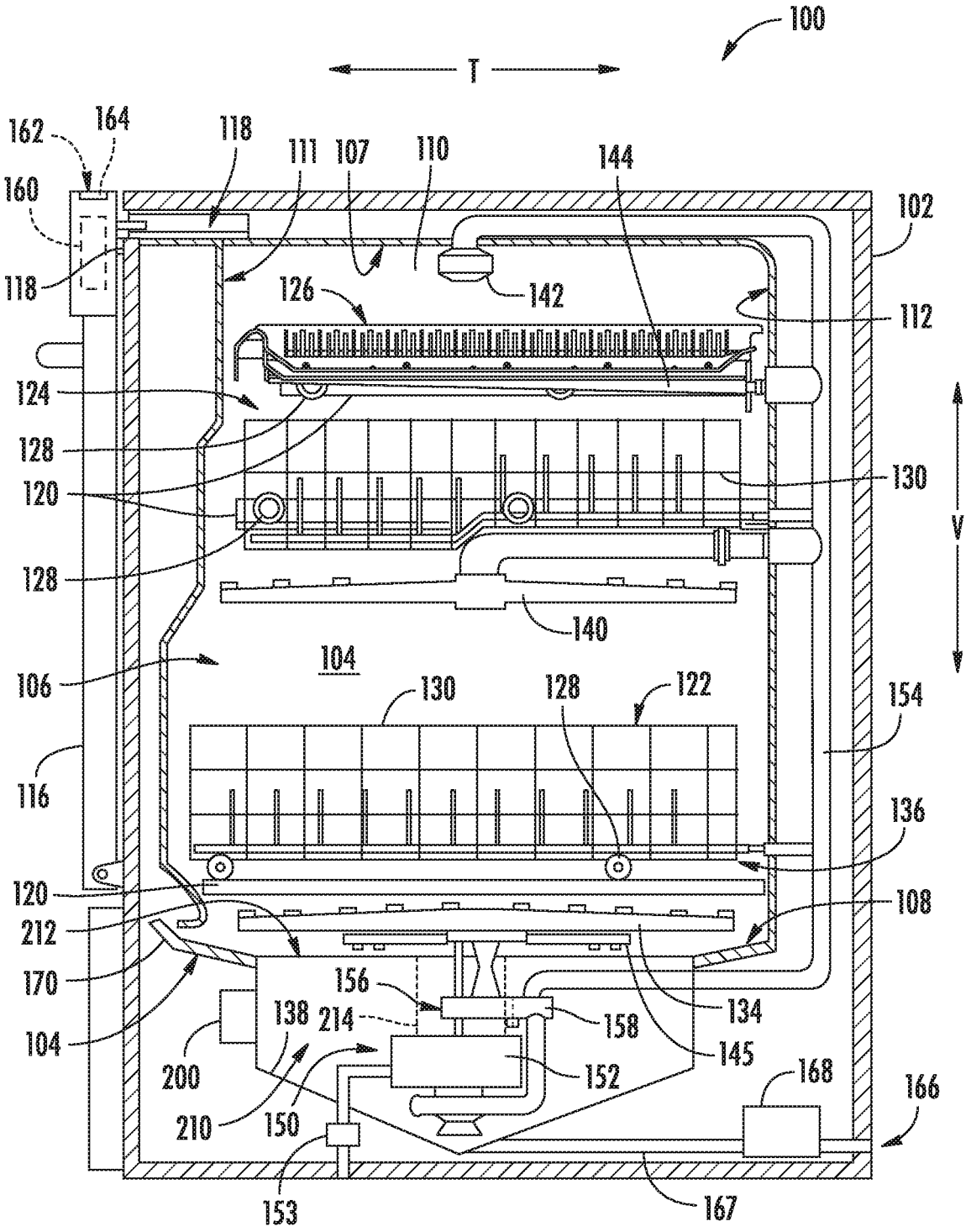
FIG. 2 provides a side, cross sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114. In some embodiments, a door 116 hinged at its bottom for movement between a normally closed vertical position, wherein the wash chamber 106 is sealed shut for washing operation, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively.

Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash fluid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash fluid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash fluid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash fluid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210. For instance, filter clean spray assembly 145 may be directed downward to urge a flow of wash fluid across a portion of filter assembly 210 (e.g., first filter 212) or sump 138.

The various spray assemblies and manifolds described herein may be part of a fluid distribution system or fluid circulation assembly 150 for circulating wash fluid in tub 104. In certain embodiments, fluid circulation assembly 150 includes a circulation pump 152 for circulating wash fluid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 can be positioned between the external water supply line and circulation pump 152 (e.g., to selectively allow water to flow from the external water supply line to circulation pump 152). Additionally or alternatively, water inlet valve 153 can be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash fluid throughout wash chamber 106.

In some embodiments, primary supply conduit 154 is used to supply wash fluid to one or more spray assemblies (e.g., to mid-level spray arm assembly 140 or upper spray assembly 142). It should be appreciated, however, that according to alternative embodiments, any other suitable plumbing configuration may be used to supply wash fluid throughout the various spray manifolds and assemblies described herein. For instance, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwashing appliance 100.

Each spray arm assembly 134, 140, 142, integral spray manifold 144, filter clean assembly 145, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In some embodiments, an exemplary filter assembly 210 is provided. As shown, in exemplary embodiments, filter assembly 210 is located in the sump 138 (e.g., to filter fluid to circulation assembly 150). Generally, filter assembly 210 removes soiled particles from the fluid that is recirculated through the wash chamber 106 during operation of dishwashing appliance 100. In exemplary embodiments, filter assembly 210 includes both a first filter 212 (also referred to as a "coarse filter") and a second filter 214 (also referred to as a "fine filter").

In some embodiments, the first filter 212 is constructed as a grate having openings for filtering fluid received from wash chamber 106. The sump 138 includes a recessed portion upstream of circulation pump 152 or a drain pump 168 and over which the first filter 212 is removably received. In exemplary embodiments, the first filter 212 operates as a coarse filter having media openings in the range of about 0.030 inches to about 0.060 inches. The recessed portion may define a filtered volume wherein debris or particles have been filtered by the first filter 212 or the second filter 214.

In additional or alternative embodiments, the second filter 214 is provided upstream of circulation pump 152 or drain pump 168. Second filter 214 may be non-removable or, alternatively, may be provided as a removable cartridge positioned in a tub receptacle 216 (FIG. 4) formed in sump 138.

Figure 3:
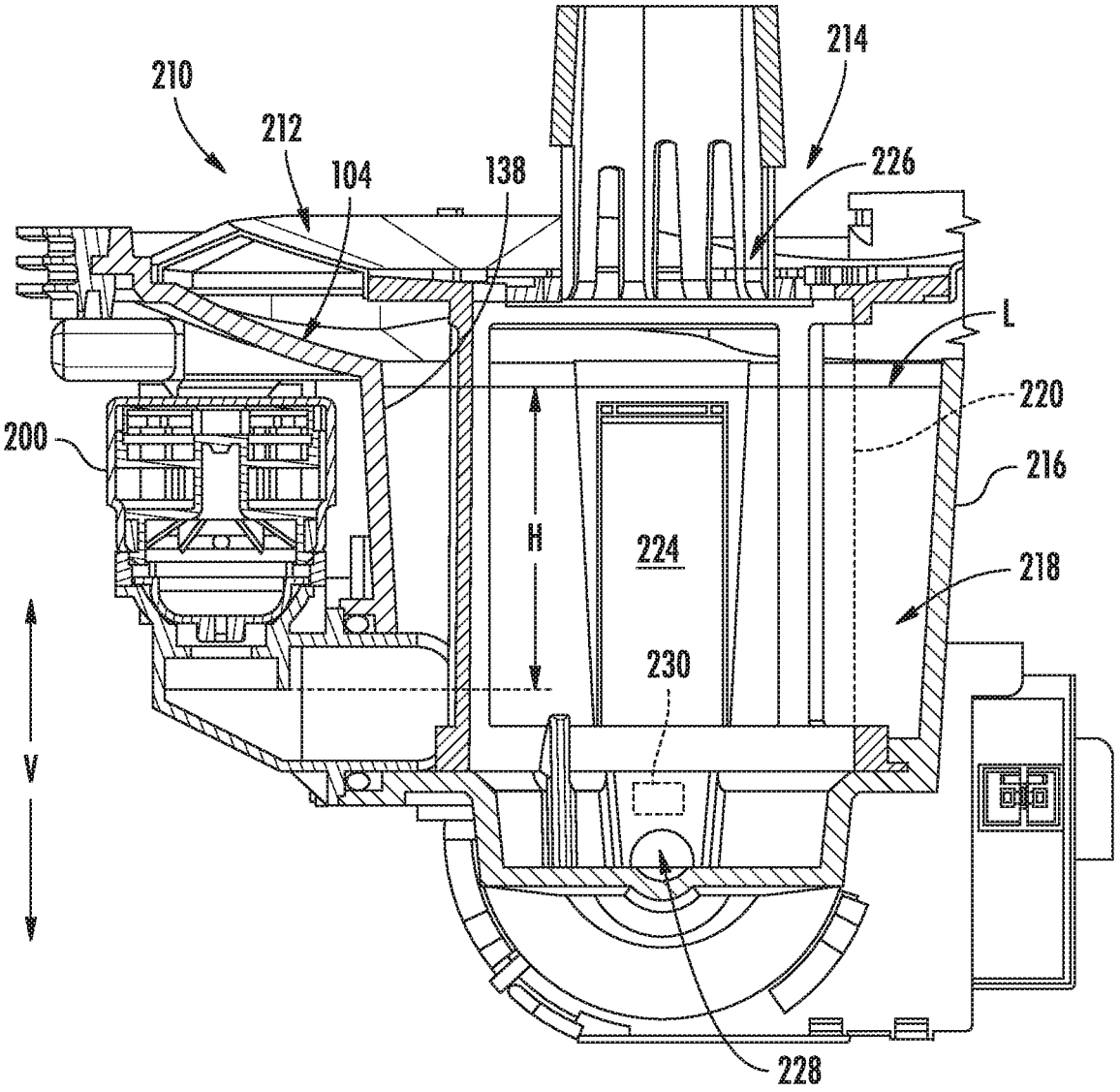
FIG. 3 provides a close up, cross sectional view of a sump and a pressure sensor of the dishwashing appliance of FIGS. 1 and 2.

For instance, turning especially to FIGS. 2 and 3, the second filter 214 may be removably positioned within a collection chamber 218 defined by tub receptacle 216. The second filter 214 may be generally shaped to complement the tub receptacle 216. For instance, the second filter 214 may include a filter wall 220 that complements the shape of the tub receptacle 216. In some embodiments, the filter wall 220 is formed from one or more fine filter media. Some such embodiments may include filter media (e.g., screen or mesh, having pore or hole sizes in the range of about 50 microns to about 600 microns).

When assembled, the filter wall 220 may have an enclosed (e.g., cylindrical) shape defining an internal chamber 224. In optional embodiments, a top portion of second filter 214 positioned above the internal chamber 224 may define one or more openings 226 (e.g., vertical flow path openings), thereby permitting fluid to flow into the internal chamber 224 without passing through the first filter 212 or the fine filter media of the filter wall 220 of the second filter 214.

Between the top portion openings 226 and drain pump 168, internal chamber 224 may define an unfiltered volume. A drain outlet 228 may be defined below the top portion openings 226 in fluid communication with internal chamber 224 and drain pump 168 (e.g., downstream of internal chamber 224 or upstream of drain pump 168).

During, for example, a drain cycle, at least a portion of wash fluid within sump 138 may generally pass into internal chamber 224 through second filter 214 (e.g., through filter wall 220 or openings 226) before flowing through drain assembly 166 and from dishwashing appliance 100.

During operation of some embodiments (e.g., during or as part of a wash cycle or rinse cycle), circulation pump 152 draws wash fluid in from sump 138 through filter assembly 210 (e.g., through first filter 212 or second filter 214). Thus, circulation pump 152 may be downstream of filter assembly 210.

In optional embodiments, circulation pump 152 urges or pumps wash fluid (e.g., from filter assembly 210) to a diverter 156. In some such embodiments, diverter 156 is positioned within sump 138 of dishwashing appliance 100). Diverter 156 may include a diverter disk (not shown) disposed within a diverter chamber 158 for selectively distributing the wash fluid to the spray arm assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash fluid to the desired spray device.

In exemplary embodiments, diverter 156 is configured for selectively distributing the flow of wash fluid from circulation pump 152 to various fluid supply conduits—only some of which are illustrated in FIG. 2 for clarity. In certain embodiments, diverter 156 includes four outlet ports (not shown) for supplying wash fluid to a first conduit for rotating lower spray arm assembly 134, a second conduit for supplying wash fluid to filter clean assembly 145, a third conduit for spraying an auxiliary rack such as the silverware rack, and a fourth conduit for supply mid-level or upper spray assemblies 140, 142 (e.g., primary supply conduit 154).

Drainage of soiled wash fluid within sump 138 may occur, for instance, through drain assembly 166 (e.g., during or as part of a drain cycle). In particular, wash fluid may exit sump 138 through a drain outlet 228 and may flow through a drain conduit 167. In some embodiments, a drain pump 168 downstream of sump 138 facilitates drainage of the soiled wash fluid by urging or pumping the wash fluid to a drain line external to dishwasher 100. Drain pump 168 may be downstream of first filter 212 or second filter 214. Additionally or alternatively, an unfiltered flow path may be defined through sump 138 to drain conduit 167 such that an unfiltered fluid flow may pass through sump 138 to drain conduit 167 without first passing through filtration media of either first filter 212 or second filter 214.

Although a separate recirculation pump 152 and drain pump 168 are described herein, it is understood that other suitable pump configurations (e.g., using only a single pump for both recirculation and draining) may be provided.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry—such as switches, amplifiers, integrators, comparators, flip-flops, AND gates, and the like—to perform control functionality instead of relying upon software).

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For instance, different locations may be provided for user interface 164, different configurations may be provided for rack assemblies 122, 124, 126, different spray arm assemblies 134, 140, 142 and spray manifold configurations may be used, and other differences may be applied while remaining within the scope of the present disclosure.

Turning especially to FIG. 3, a close up, cross sectional view of sump 138 and a pressure sensor 200 is provided. In some instances, portions of dishwasher 100 may become obstructed or clogged (e.g., at filter assembly 210). Accordingly, and in accordance with exemplary aspects of the present disclosure, dishwasher 100 utilizes outputs from pressure sensor 200 to monitor or prevent obstructions or clogs.

In some embodiments, pressure sensor 200 mounted to sump 138. For instance, pressure sensor 200 may be mounted upstream of internal chamber 224 and second filter 214. Additionally or alternatively, pressure sensor 200 may be mounted downstream of first filter 212.

Pressure sensor 200 is operatively configured to detect a liquid level L within sump 138 and communicate the liquid level L to controller 160 (FIG. 2) via one or more signals. Thus, pressure sensor 200 and controller 160 are generally provided in operative communication.

During use, pressure sensor 200 may transmit signals to controller 160 for instance, as a frequency, as an analog signal, or in another suitable manner or form that can be received by controller 160 to detect a pressure value (e.g., as a value of relative pressure or hydrostatic pressure, such as value in units of $mmH_2O$). In certain embodiments, pressure sensor 200 is configured to sense the height H of the wash fluid above pressure sensor 200 along the vertical direction V (e.g., by detecting the pressure on pressure sensor 200).

In some embodiments, pressure sensor 200 includes a pressure plate that is generally acted on by the pressure of the wash fluid within sump 138. As the liquid level L rises, the pressure plate is pushed upward along the vertical direction V and, thus, compresses air trapped within the housing and a diaphragm of pressure sensor 200. Compression may cause the diaphragm to flex or alter its position. As a result of the pressure and consequent movement of the diaphragm, a permanent magnet attached to the diaphragm may change its position in relation to a Hall-effect transducer. The transducer delivers one or more electrical signals proportional to the magnetic field of the magnet. Optionally, the signals from pressure sensor 200 may be linearized, digitized, or amplified before being sent to controller 160 for processing. Additionally or alternatively, the pressure sensor 200 may include a printed circuit board (PCB) board to electrically connect the various electrical components of pressure sensor 200. Moreover, pressure sensor 200 can be any suitable type of sensor capable of sensing the liquid level L within dishwasher 100.

Notably, as an upstream sensor (e.g., upstream of circulation pump 152 or drain pump 168), signals from pressure sensor 200 may be used or configured for additional detections, such as detection of overfill or flood event (e.g., as would be caused by an out-of-level condition, an inlet water valve failure, or a drain pump failure) that would otherwise go undetected by a pressure sensor downstream (i.e., on the high-pressure side) of circulation pump 152 or drain pump 168.

In additional or alternative embodiments, a secondary fluid sensor 230 is provided in fluid communication between filter assembly 210 and drain outlet 228. In particular, secondary fluid sensor 230 may be downstream from second filter 214. For example, secondary fluid sensor 230 may be mounted within a portion of internal chamber 224 and configured to detect a fluid (e.g., wash fluid) level or fluid pressure within internal chamber 224. In some such embodiments, the detected fluid level detected at secondary fluid sensor 230 is independent of detected pressure at pressure sensor 200.

Generally, secondary fluid sensor 230 may be any suitable sensor configured to detect at least one predetermined fluid level within internal chamber 224. For instance, secondary fluid sensor 230 may include or be provided as a float switch, diaphragm pressure sensor, capacitive sensor, or optical sensor configured to detect fluid within internal chamber 224 (e.g., at the vertical position of secondary fluid sensor 230).

During use, secondary fluid sensor 230 may transmit signals to controller 160 for instance, as a frequency, as an analog signal, or in another suitable manner or form that can be received by controller 160. Thus, secondary fluid sensor 230 and controller 160 are generally provided in operative communication. From the signal or signal(s) received from secondary fluid sensor 230, controller 160 may be configured to determine if or how much (e.g., a height or volume of) fluid within internal chamber 224. In particular, based on one or more signals received from secondary fluid sensor 230, controller 160 may be configured to determine virtually no wash fluid is within internal chamber 224 (e.g., wash fluid within internal chamber 224 has reached a predetermined minimum level) and drain pump 168 has reached or is in a dry pump state (e.g., in which drain pump 168 is active, but no wash fluid is being drawn therethrough).

In further additional or alternative embodiments, controller 160 is configured to determine if or how much (e.g., a height or volume of) fluid is present within internal chamber 224 based on one or more signals to/from drain pump 168. For instance, controller 160 may be configured to determine an electric current (e.g., value in Amperes) at drain pump 168. Additionally or alternatively, controller 160 may determine an electric current variation (e.g., value of current variation in Amperes over time) at drain pump 168. Based on the determined current or current variation, controller 160 may be configured to determine drain pump 168 has reached or is in a dry pump state (e.g., in which drain pump 168 is active, but no wash fluid is being drawn therethrough). As an example, if a determined electric current value is less than or equal to a predetermined minimum current value, controller 160 may determine a dry pump state. As another example, if a determined electric current variation value is greater than or equal to a predetermined minimum current variation value, controller 160 may determine a dry pump state.

Figure 4:
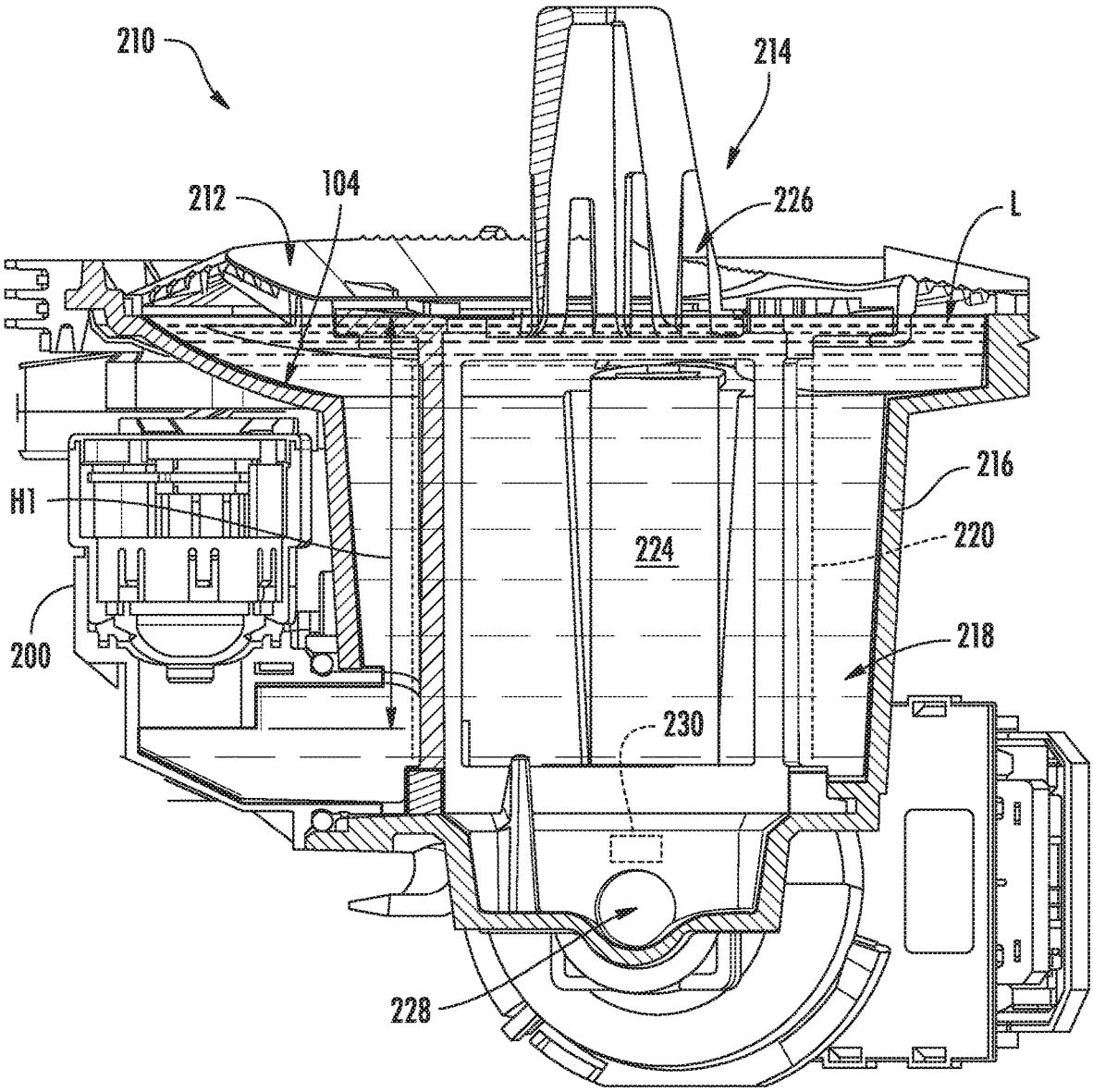
FIG. 4 provides a close up, cross sectional view of a sump and a pressure sensor in a static state.
Figure 6:
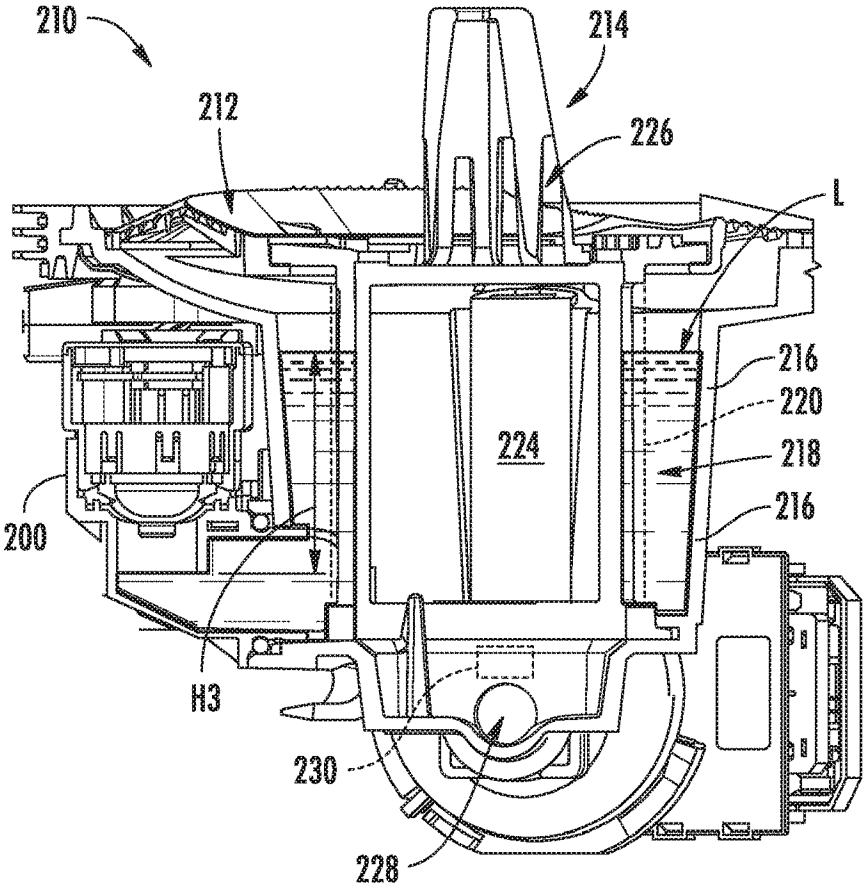
FIG. 6 provides a close up, cross sectional view of a sump and a pressure sensor in a dry pump state.
Figure 5:
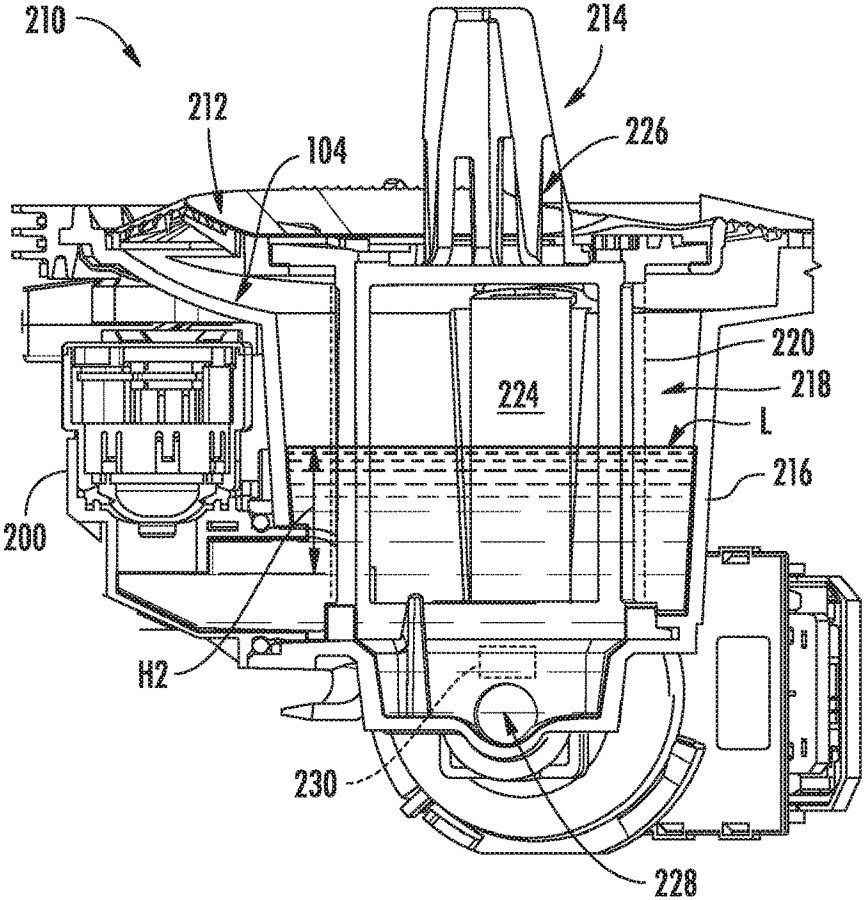
FIG. 5 provides a close up, cross sectional view of a sump and a pressure sensor in a wet pump state.

Turning especially to FIGS. 4 through 6, a portion of sump 138 is illustrated at various states. Specifically, FIG. 4 illustrates sump 138 in a static state, such as after a fill sequence, wash cycle, or rinse cycle has been performed and prior to a drain cycle. FIG. 5 illustrates sump 138 in a wet pump state, such as during a drain cycle wherein second filter 214 is generally clean and free from obstruction. FIG. 6 illustrates sump 138 in a dry pump state, such as during a drain cycle wherein second filter 214 is significantly dirty or obstructed.

As illustrated at FIG. 4, prior to a drain cycle, a volume of wash fluid is generally held within sump 138 (e.g., at a height H1 detected at pressure sensor 200). Drain pump 168 (FIG. 2) is inactive and the height is constant across sump 138 (e.g., within collection chamber 218), both within and outside of internal chamber 224. If drain pump 168 is activated while second filter 214 is generally clean, as illustrated at FIG. 5, wash fluid is drawn through drain outlet 228 and generally pulls evenly from sump 138 (e.g., within collection chamber 218). Thus, the height H2 remains constant across collection chamber 218, both within and outside of internal chamber 224. The height H2 detected by pressure sensor 200 will be consistent with the detection of wash fluid within internal chamber 224 (e.g., by secondary fluid sensor 230 or controller 160). By contrast, if drain pump 168 is activated while second filter 214 is dirty or obstructed, as illustrated at FIG. 6, wash fluid is drawn through drain outlet 228 unevenly from sump 138 (e.g., within collection chamber 218). Specifically, wash fluid is drawn first through internal chamber 224 without pulling from the region of collection chamber 218 outside of internal chamber 224. Thus, the height within internal chamber 224 will be significantly lower than the height H3 of wash fluid detected by pressure sensor 200. When the height of wash fluid within internal chamber 224 goes to zero or substantially all of the wash fluid is drawn from internal chamber 224, an inconsistent (e.g., significantly higher height H3 may be detected at pressure sensor 200). In other words, the height detected by pressure sensor 200 may be inconsistent with the detection (or absence thereof) of wash fluid within internal chamber 224 (e.g., by secondary fluid sensor 230 or controller 160).

Figure 7:
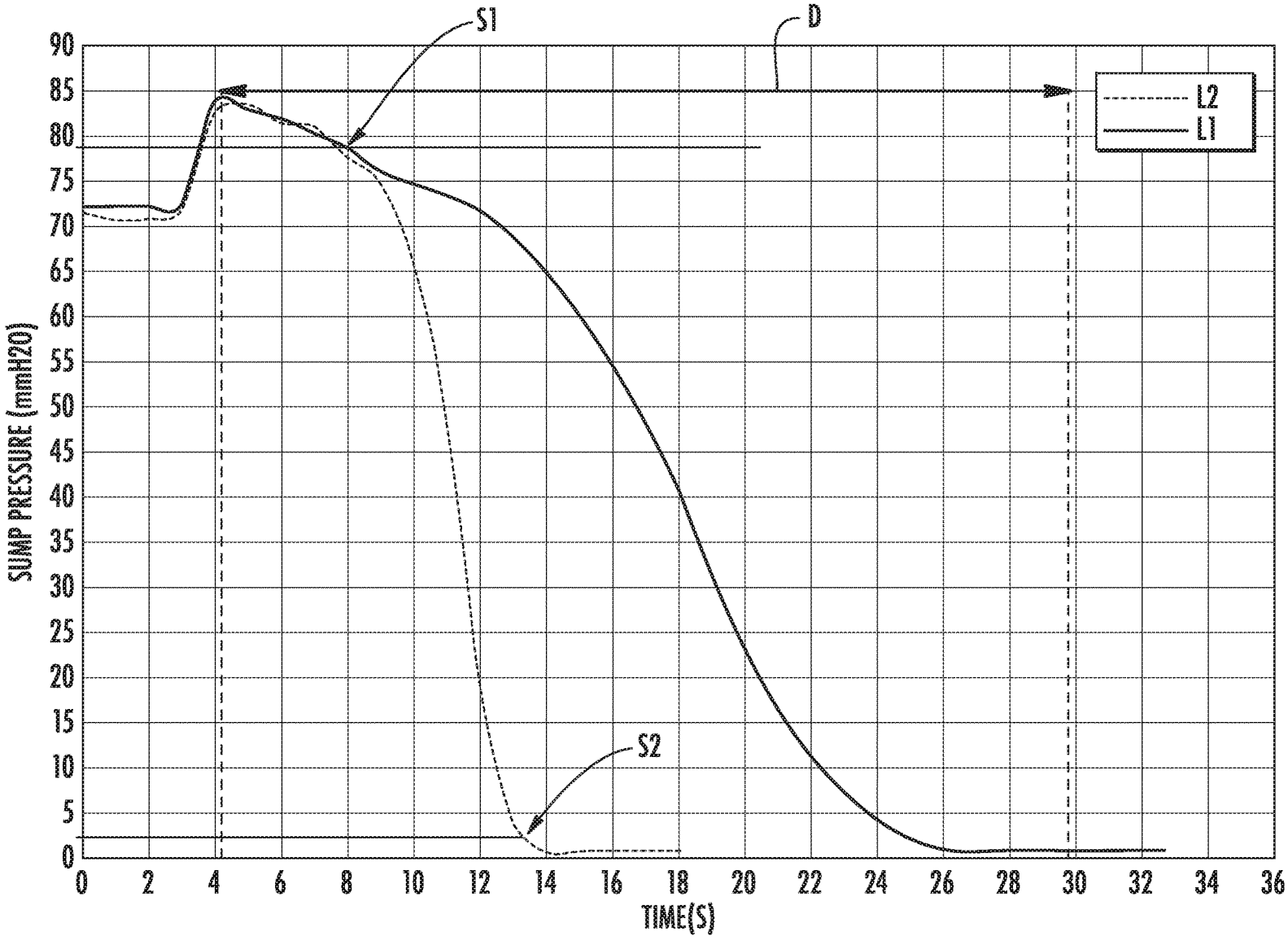
FIG. 7 provides a chart illustrating detected pressure over time during a dishwashing operation.

Turning briefly to FIG. 7, a chart is provided illustrating pressure values (e.g., detected at an upstream pressure sensor 200) over a period of time. Specifically, FIG. 7 illustrates two discrete instances of operation of an exemplary dishwasher (e.g., dishwasher 100—FIG. 1) at L1 and L2 during a drain period D. Line L1 depicts pressure during operation of the exemplary dishwasher during a drain cycle wherein the dishwasher is generally clean or otherwise free of obstructions/clogs (e.g., within a filter assembly 210—FIG. 2). Line L2 depicts pressure during operation of an exemplary dishwasher 100 that contains includes a dirty or obstructed filter (e.g., within a fine filter of filter assembly 210—FIG. 2). As shown, a dry pump state point S1 is determined at L1 when detected pressure is relatively low. By contrast, a dry pump state point S2 is determined at L2 when detected pressure is relatively high. Advantageously, the correlation between detection of a dry pump state and a relatively high detected pressure at an upstream pressure sensor may thus permit determination of a condition (e.g., clean or dirty) of a filter assembly.

Figure 8:
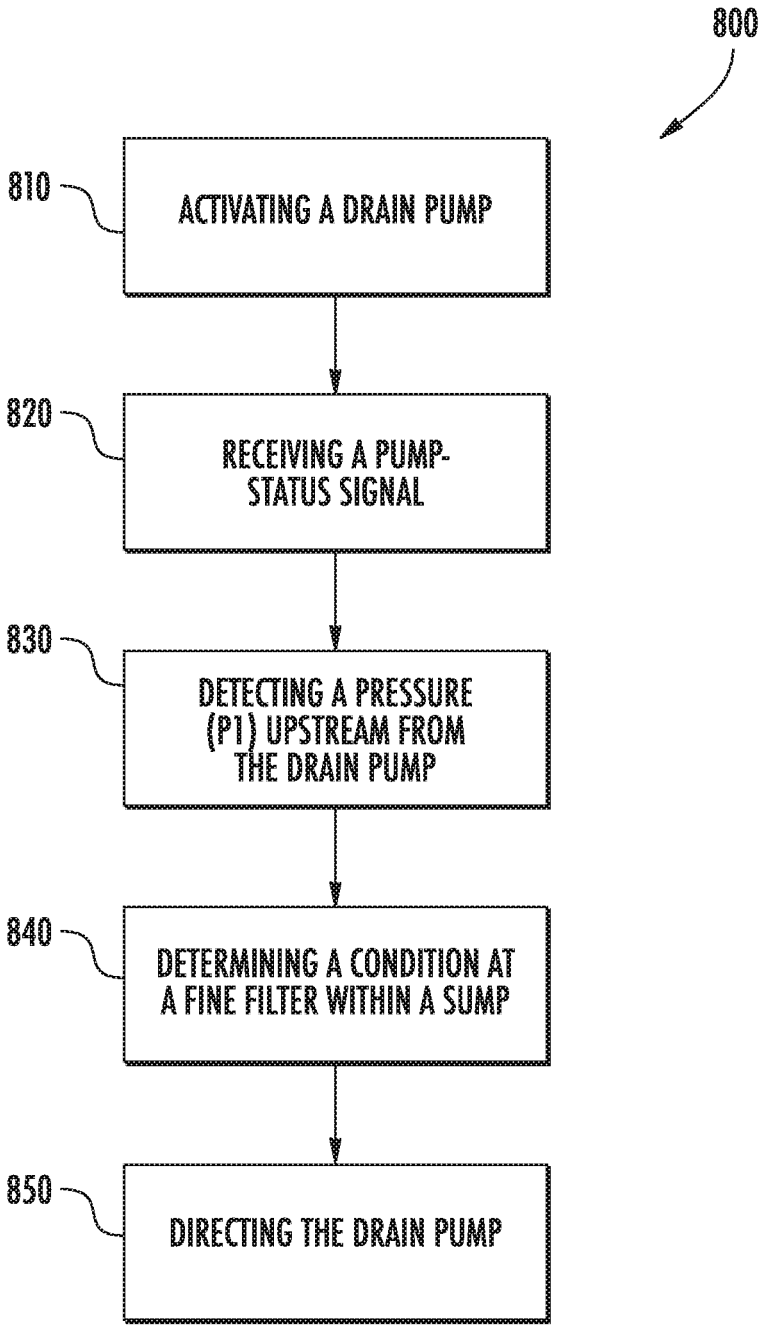
FIG. 8 provides a flow chart of a method of operating a dishwashing appliance, according to an exemplary embodiment of the present disclosure.
Figure 9:
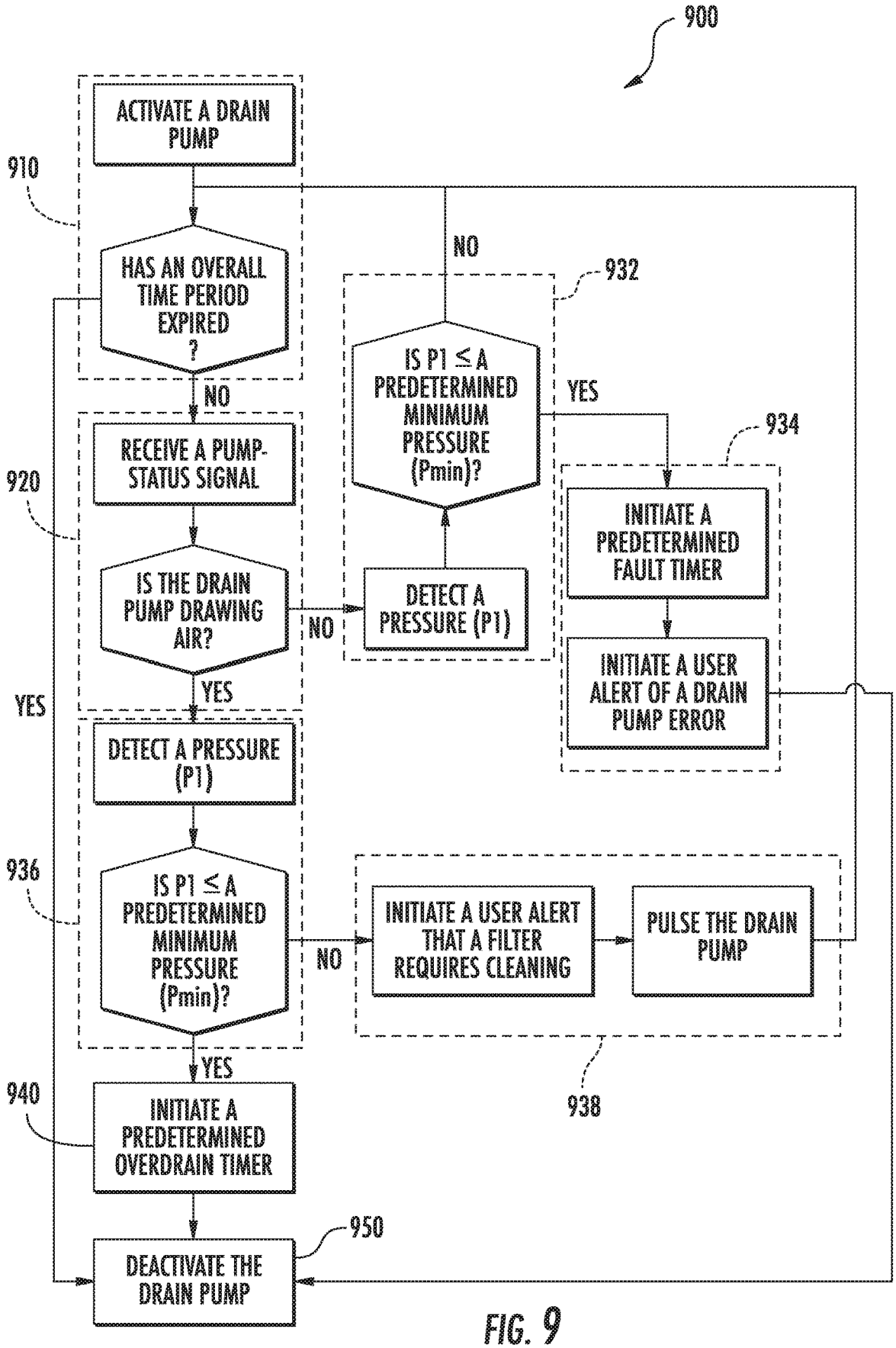
FIG. 9 provides a flow chart of a method of operating a dishwashing appliance, according to an exemplary embodiment of the present disclosure.

Turning now to FIGS. 8 and 9, various methods 800 and 900 for operating a dishwashing appliance are illustrated. Methods 800 and 900 may be used to operate any suitable dishwashing appliance. As an example, some or all of methods 800 and 900 may be used to operate dishwashing appliance 100 (FIG. 1). The controller 160 (FIG. 2) may be programmed to implement some or all of methods 800 and 900 (e.g., as or as part of a wash operation, such as at a drain cycle).

Turning especially to FIG. 8, at 810, the method 800 includes activating the drain pump (e.g., from an inactive state) for an activation period. Generally, the drain pump remains active during the activation period. For instance, the drain pump may actively urge or motivate a fluid flow. The activation period may be a continuous activation period such that, for a predetermined period of time, the drain pump is directed to operate uninterrupted in an attempt to motivate a substantially continuous or non-pulsated fluid flow (e.g., as in continuous flow state) through the drain conduit and out of the dishwashing appliance. In some embodiments, the activation period is programmed as a predetermined overall time period during which the drain pump remains active (e.g., maximum run time).

In certain embodiments, 810 follows (e.g., occurs subsequent to) a portion of a wash cycle or rinse cycle. For instance, 810 may occur after a volume of wash fluid has been supplied to wash chamber. The wash chamber may thus be filled with a volume of wash fluid at the start of 810. Optionally, prior to 810, the volume of wash fluid may be static within the sump.

At 820, the method 800 includes receiving a pump-status signal during the activation period. For instance, the pump-status signal may be received from a secondary fluid sensor or the drain pump, as described above. Moreover, 820 may occur after the initiation of the activation period at 810, but while the drain pump continues to actively operate to urge or motivate a fluid flow (e.g., in a continuous flow state).

In exemplary embodiments, the pump-status signal is or includes a fluid level signal, electric current signal, or any other suitable signal for determining whether (or what level/volume of) a wash fluid is present within, for example, an internal chamber of a fine filter mounted within the sump. In some such embodiments, once the pump-status signal is received, the pump-status signal may be interpreted as a value (e.g., of fluid level, electric current, electric current variation, etc.).

In certain embodiments, the method 800 further includes determining a status or state of the drain pump based on the pump-status signal. For instance, the status may be determined to be one of a wet pump state or a dry pump state. Optionally, the status may be determined as a binary choice (e.g., yes or no) as to whether a dry pump state has been determined.

In exemplary embodiments, the status or state of the drain pump is determined based on a pump-status signal that is or includes a fluid level signal received from a secondary fluid sensor that is downstream from the filter assembly (e.g., fine filter), as described above. The method 800 may include determining whether wash fluid within and internal chamber has fallen to a predetermined fluid level (e.g., minimum height). A wet pump state may be determined in response to a determination that fluid within the internal chamber has not fallen to the predetermined fluid level. A dry pump state may be determined in response to a determination that fluid within the internal chamber has fallen to the predetermined fluid level.

In additional or alternative embodiments, the status or state of the drain pump is determined based on a pump-status signal that is or includes an electric current signal received from the drain pump, as described above. The method 800 may include determining an electric current value based on the electric current signal. Furthermore, the method 800 may include comparing the determined electric current value to a predetermined minimum current value. If the determined electric current value is greater than the predetermined minimum current value, a wet pump state may be determined. If the determined electric current value is less than or equal to the predetermined minimum current value, a dry pump state may be determined.

In further additional or alternative embodiments, the status or state of the drain pump is determined based on a pump-status signal that is or includes an electric current signal received from the drain pump, as described above. The method 800 may include determining an electric current variation value based on the electric current signal. Furthermore, the method 800 may include comparing the determined electric current variation value to a predetermined minimum variation value. If the determined electric current variation value is less than the predetermined minimum variation value, a wet pump state may be determined. If the determined electric current variation value is greater than or equal to the predetermined minimum variation value, a dry pump state may be determined.

At 830, the method 800 includes detecting a pressure (P1) (e.g., as a value of relative pressure in millimeters of water) upstream from the drain pump. Specifically, P1 is detected during the activation period. Thus, P1 may be an active pumping pressure. Moreover, 830 may occur after the initiation of the activation period at 810, but while the drain pump continues to actively operate to urge or motivate a fluid flow (e.g., in a continuous flow state). Optionally, 830 may follow 820.

As described above, the pressure sensor (and thus the detected pressure) may also be upstream of at least a portion of the filter assembly (e.g., fine filter) or within a collection chamber.

At 840, the method 800 includes determining a condition at the filter assembly (e.g., at the fine filter) within the sump based on the pump-status signal and P1. For instance, 840 may be based on a determined state of the drain pump as well as P1.

In some embodiments, 840 include comparing P1 to a predetermined pressure limit (Pmin) (e.g., provided as a value of relative pressure or hydrostatic pressure, such as value in units of $mmH_2O$). Thus, a determination at 840 may be made that P1 is less than or equal to Pmin or, alternatively, P1 is greater than Pmin.

In optional embodiments, the determined condition at the filter assembly may be that the filter assembly is clean (e.g., a first clean condition or a second clean condition), that the filter assembly is dirty or otherwise obstructed (e.g., a dirty condition), or, alternatively, that a system fault is likely (e.g., fault condition).

As an example, a first clean condition may be determined in response to the determined state of the drain pump being a wet pump state and P1 being greater than Pmin. As an additional or alternative example, a second clean condition may be determined in response to the determined state of the drain pump being a dry pump state and P1 being less than or equal to Pmin. As another additional or alternative example, a dirty condition may be determined in response to the determined state of the drain pump being a dry pump state and P1 being greater than Pmin. As yet another additional or alternative example, a fault condition may be determined in response to the determined state of the drain pump being a wet pump state and P1 being less than or equal to Pmin.

At 850, the method 800 includes directing the drain pump based on the determined condition. Thus, 850 follows 840. Generally, 850 may include various actions for the drain pump, such as maintaining the drain pump in an active state, initiating a predetermined overdrain or fault timer (e.g., after which the drain pump will be deactivated), pulsing the drain pump (e.g., in response to determining P1 is greater than Pmin), etc.

In exemplary embodiments, in response to a first clean condition, 850 includes directing continued (e.g., continuous) operation of the drain pump. In other words, 850 includes maintaining the drain pump in an active state. Activation of the drain pump may continue, for instance, until the activation time period or an overall time period expires.

In additional or alternative embodiments, in response to a second clean condition, 850 includes initiating a predetermined overdrain timer (e.g., countdown from a predetermined value of time). Thus, the predetermined overdrain timer may be initiated, at least in part, in response to a determination that P1 is less than or equal to Pmin. The predetermined overdrain timer may control deactivation of the drain pump. Upon expiration of the predetermined overdrain timer, the drain pump may be deactivated irrespective of any other timer or period (e.g., activation period or overall time period). Optionally, the drain cycle as a whole may be ended.

In other additional or alternative embodiments, in response to a dirty condition, 850 includes pulsing the drain pump. Thus, pulsing the drain pump may be initiated, at least in part, in response to a determination that P1 is greater than Pmin. In order for pulsing to occur, a pulsating sequence may be initiated. The pulsating sequence may include activating the drain pump for a pulsating activation period during which the drain pump is active according to a set pulsating pattern. Thus, the drain pump may draw wash fluid at an interrupted pace with sequential, discrete pulses, as is understood. Wash fluid may be permitted to briefly accumulate within, for example, the internal chamber, before the drain pump draws it through the drain outlet.

In further additional or alternative embodiments, in response to a dirty condition, 850 includes initiating a user alert (e.g., cleaning alert) at a user interface of the dishwashing appliance. Thus, initiating a user alert may be, at least in part, in response to a determination that P1 is greater than Pmin. The user alert may include an audio or visual alert. Thus, a user may be advantageously informed that the filter is in need of or requires cleaning. As an example, a speaker may be directed to generate an audible sound wave corresponding to the determined dirty condition. As another example, a controller may direct a light source or display of the user interface to transmit a visual identifier corresponding to the determined dirty condition.

In yet further additional or alternative embodiments, in response to a fault condition, 850 includes initiating a predetermined fault timer (e.g., countdown from a predetermined value of time). Thus, the predetermined fault timer may be initiated, at least in part, in response to a determination that P1 is less than or equal to Pmin. The predetermined fault timer may control deactivation of the drain pump. Upon expiration of the predetermined fault timer, the drain pump may be deactivated irrespective of any other timer or period (e.g., activation period or overall time period). Optionally, the drain cycle as a whole may be ended.

In still further additional or alternative embodiments, in response to a fault condition, 850 includes initiating a user alert (e.g., pump error alert) at a user interface of the dishwashing appliance. Thus, the user alert may be initiated, at least in part, in response to a determination that P1 is less than or equal to Pmin. The user alert may include an audio or visual alert. Thus, a user may be advantageously informed that the drain pump is in need of service. As an example, a speaker may be directed to generate an audible sound wave corresponding to the determined fault condition. As another example, a controller may direct a light source or display of the user interface to transmit a visual identifier corresponding to the determined fault condition.

Turning now especially to FIG. 9, at 910, the method 900 includes activating the drain pump (e.g., from an inactive state). For instance, the drain pump may actively urge or motivate a fluid flow. While active, the drain pump may be directed to operate uninterrupted in an attempt to motivate a substantially continuous or non-pulsated fluid flow (e.g., as in continuous flow state) through the drain conduit and out of the dishwashing appliance.

Activation of the drain pump may be limited to an overall drain period (e.g., maximum period of continuous activation for a corresponding drain cycle). In turn, 910 may include a determination as to whether the overall drain period has expired. If the overall drain period has not expired, the method 900 may continue to 920. If the overall drain period has expired, the method 900 may proceed directly to 950.

At 920, the method 900 includes evaluating a pump-status of the drain pump (e.g., following 910). The evaluation at 920 may include receiving a pump-status signal and determining whether the drain pump is drawing air (i.e., whether the drain pump is in a dry pump state). Moreover, 920 may occur after activation of the drain pump at 910, but while the drain pump continues to actively operate to urge or motivate a fluid flow (e.g., in a continuous flow state). If a determination is made that the drain pump is not drawing air, the method 900 may proceed to 932. If a determination is made that the drain pump is drawing air, the method may proceed to 936.

At 920, the pump-status signal may be received from a secondary fluid sensor or the drain pump, as described above. In exemplary embodiments, the pump-status signal is or includes a fluid level signal, electric current signal, or any other suitable signal for determining whether (or what level/volume of) a wash fluid is present within, for example, an internal chamber of a fine filter mounted within the sump. In some such embodiments, once the pump-status signal is received, 920 includes interpreting the pump-status signal as a value (e.g., of fluid level, electric current, electric current variation, etc.).

In exemplary embodiments, the determination of whether the drain pump is drawing air at 920 is based on a pump-status signal that is or includes a fluid level signal received from a secondary fluid sensor that is downstream from the filter assembly (e.g., fine filter), as described above. The determination at 920 may include determining whether wash fluid within internal chamber has fallen to a predetermined fluid level (e.g., minimum height). If fluid within internal chamber has not fallen to the predetermined fluid level, the drain pump may not be drawing air. If fluid within internal chamber has fallen to the predetermined fluid level based, the drain pump may be drawing air.

In additional or alternative embodiments, the determination of whether the drain pump is drawing air at 920 is based on a pump-status signal that is or includes an electric current signal received from the drain pump, as described above. The determination at 920 may include determining an electric current value based on the electric current signal. Furthermore, 920 may include comparing the determined electric current value to a predetermined minimum current value. If the determined electric current value is greater than the predetermined minimum current value, the drain pump may not be drawing air. If the determined electric current value is less than or equal to the predetermined minimum current value, the drain pump may be drawing air.

In further additional or alternative embodiments, the determination of whether the drain pump is drawing air at 920 is based on a pump-status signal that is or includes an electric current signal received from the drain pump, as described above. The determination at 920 may include determining an electric current variation value based on the electric current signal. Furthermore, 920 may include comparing the determined electric current variation value to a predetermined minimum variation value. If the determined electric current variation value is less than the predetermined minimum variation value, the drain pump may not be drawing air. If the determined electric current variation value is greater than or equal to the predetermined minimum variation value, the drain pump may be drawing air.

As noted above, if a determination is made that the drain pump is not drawing air at 920, the method 900 may proceed to 932.

At 932, the method 900 includes evaluating pressure upstream of the drain pump. In particular, 932 includes detecting a pressure (P1) (e.g., as a value of relative pressure in millimeters of water) upstream from the drain pump (e.g., at a pressure sensor, as described above) and comparing P1 to predetermined minimum pressure (Pmin). As described above, the pressure sensor (and thus the detected pressure) may also be upstream of at least a portion of the filter assembly (e.g., fine filter) or within a collection chamber.

Generally, P1 may be an active pumping pressure. Moreover, 932 may occur after the activation of the drain pump at 910, but while the drain pump continues to actively operate to urge or motivate a fluid flow (e.g., in a continuous flow state).

If P1 is determined to be greater than Pmin at 932 (i.e., not less than or equal to Pmin) at 932, the method 900 may return to 910 (e.g., while maintaining the drain pump in an active state). By contrast, if P1 is determined to be less than or equal to Pmin at 932, a fault condition may be considered present and the method 900 may proceed to 934.

At 934, the method 900 includes addressing a fault condition. As shown, a fault timer may be initiated in tandem with or separate from a user alert.

The predetermined fault timer at 934 may control deactivation of the drain pump. Upon expiration of the predetermined fault timer, the drain pump may be deactivated irrespective of any other timer or period (e.g., overall drain period). Thus, upon completion or expiration of the predetermined fault timer, the method 900 may proceed directly to 950.

The user alert at 934 may include an audio or visual alert. Thus, a user may be advantageously informed that the drain pump is in need of service. As an example, a speaker may be directed to generate an audible sound wave corresponding to the determined fault condition. As another example, a controller may direct a light source or display of the user interface to transmit a visual identifier corresponding to the determined fault condition.

Returning to 920, and as noted above, if a determination is made that the drain pump is drawing air at 920, the method 900 may proceed to 936 (e.g., instead of 932 and 934).

At 936, the method 900 includes evaluating pressure upstream of the drain pump. In particular, 936 includes detecting a pressure (P1) (e.g., as a value of relative pressure in millimeters of water) upstream from the drain pump (e.g., at a pressure sensor, as described above) and comparing P1 to predetermined minimum pressure (Pmin). As described above, the pressure sensor (and thus the detected pressure) may also be upstream of at least a portion of the filter assembly (e.g., fine filter) or within a collection chamber.

Generally, P1 may be an active pumping pressure. Moreover, 936 may occur after the activation of the drain pump at 910, but while the drain pump continues to actively operate to urge or motivate a fluid flow (e.g., in a continuous flow state).

If P1 is determined to be greater than Pmin at 936 (i.e., not less than or equal to Pmin) at 936, at least a portion of the filter assembly (e.g., fine filter) may be considered dirty or otherwise obstructed and the method 900 may proceed to 938. By contrast, if P1 is determined to be less than or equal to Pmin at 936, at least a portion of the filter assembly (e.g., fine filter) may be considered clean and the method 900 may proceed to 940.

At 938, the method 900 includes addressing a dirty condition. As shown, a user alert may be initiated in tandem with or separate from pulsing the drain pump.

The user alert at 938 may include an audio or visual alert. Thus, a user may be advantageously informed that the filter is in need of or requires cleaning. As an example, a speaker may be directed to generate an audible sound wave corresponding to the determined dirty condition. As another example, a controller may direct a light source or display of the user interface to transmit a visual identifier corresponding to the determined dirty condition.

Pulsing the drain motor at 938 may be provided as a pulsating sequence. The pulsating sequence may include activating the drain pump for a pulsating activation period during which the drain pump is active according to a set pulsating pattern. Thus, the drain pump may draw wash fluid at an interrupted pace with sequential, discrete pulses, as is understood. Wash fluid may be permitted to briefly accumulate within, for example, the internal chamber, before the drain pump draws it through the drain outlet. Upon completion or expiration of the pulsating sequence at 938, the method 900 may return to 910 (e.g., and reactivate the drain pump for continuous fluid flow).

Returning to 936, as noted above, if P1 is determined to be less than or equal to Pmin at 936, the method 900 may proceed to 940.

At 940, the method 900 includes initiating a predetermined overdrain timer. Upon expiration of the predetermined overdrain timer, the drain pump may be deactivated irrespective of any other timer or period (e.g., overall drain period). Thus, upon completion or expiration of the predetermined overdrain timer, the method 900 may proceed directly to 950.

At 950, the method 900 includes deactivating the drain pump, as shown. As understood, upon deactivation of the drain pump, the washing operation may continue to another cycle or end operation entirely.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a cabinet;

a tub positioned within the cabinet and defining a wash chamber for receipt of articles for washing;

a spray assembly positioned within the wash chamber;

a drain pump in fluid communication with the wash chamber;

a filter mounted within the tub upstream of the drain pump;

a pressure sensor upstream of the drain pump and the filter while being downstream of the wash chamber such that the pressure sensor is in fluid communication between the wash chamber and the filter; and a controller in operative communication with the pressure sensor and the drain pump, the controller being configured to initiate a wash operation, the wash operation comprising activating the drain pump for an activation period, receiving a pump-status signal during the activation period, detecting a pressure (P1) upstream from the drain pump during the activation period following receiving the pump-status signal, determining a condition at the filter based on both the pump-status signal and P1, and directing the drain pump based on the determined condition.

2. The dishwashing appliance of claim 1, wherein determining the condition at the filter comprises comparing P1 to a predetermined pressure limit (Pmin), and determining P1 is less than or equal to Pmin.

3. The dishwashing appliance of claim 2, wherein directing the drain pump comprises initiating a predetermined fault timer in response to determining P1 is less than or equal to Pmin, and deactivating the drain pump in response to expiration of the fault timer.

4. The dishwashing appliance of claim 1, wherein determining the condition at the filter comprises comparing P1 to a predetermined pressure limit (Pmin), and determining P1 is greater than Pmin.

5. The dishwashing appliance of claim 4, wherein directing the drain pump comprises pulsing the drain pump in response to determining P1 is greater than Pmin.

6. The dishwashing appliance of claim 4, further comprising:

a user interface attached to the cabinet in operable communication with the controller, wherein the wash operation further comprises initiating a user alert at a user interface of the dishwashing appliance in response to determining P1 is greater than Pmin.

7. The dishwashing appliance of claim 1, further comprising:

a secondary fluid sensor mounted in fluid communication between the filter and the drain pump, wherein the status signal is received as fluid level signal from the secondary fluid sensor.

8. The dishwashing appliance of claim 1, wherein the status signal is received as an electric current signal from the drain pump.

9. The dishwashing appliance of claim 8, wherein the wash operation further comprises determining an electric current value based on the electric current signal, and comparing the determined electric current value to a predetermined minimum current value.

10. The dishwashing appliance of claim 8, wherein the wash operation further comprises determining an electric current variation value based on the electric current signal, and comparing the electric current variation value to a predetermined minimum variation value.

* * * * *